United States Patent [19]

Roney

[11] 3,930,511

[45] Jan. 6, 1976

[54] DUAL HAIR PIN

[76] Inventor: Joe L. Roney, 19108 Celtic, Northridge, Calif. 91324

[22] Filed: Oct. 17, 1974

[21] Appl. No.: 515,447

[52] U.S. Cl. ..... 132/50 R

[51] Int. Cl.[2] ..... A45D 8/02

[58] Field of Search .... 132/50 R, 46 R, 46 A, 48 R, 132/48 A

[56] References Cited

UNITED STATES PATENTS

| | | | |
|---|---|---|---|
| 2,699,790 | 1/1955 | Porteous | 132/50 R |
| 2,791,226 | 5/1957 | Kurz | 132/50 R |
| 3,194,248 | 7/1965 | Callies | 132/50 R |

*Primary Examiner*—G. E. McNeill

*Attorney, Agent, or Firm*—Fulwider Patton Rieber Lee & Utecht

[57] ABSTRACT

A hair pin made from a continuous resilient band folded back on opposite sides forming a loop at each end to provide a pair of pincers having a common inner member, and disposed in substantially opposite directions.

1 Claim, 5 Drawing Figures

DUAL HAIR PIN

BACKGROUND OF THE INVENTION

This invention lies within the field of hair pins.

Hair pins currently used, and more specifically bobby pins, generally comprise a continuous band of resilient metal folded substantially in half to form a loop at one end, and a pair of substantially co-terminal tines at the other end. An intermediate portion between the ends is partially crimped in compact relationship to provide a resilient pincer for a strand of hair which has been placed between the tines of the pin.

When a strand of hair is placed in the pin, the tines are spread. The resilient action of the pin combined with the spreading of the tines tends to work the strand of hair out of the open end of the pin. Furthermore, the pin is not anchored against movement with respect to the hair, so that relative movement of the pin may cause dislodgement of the hair from the pin. The foregoing deficiencies often cause wisps of hair to become unpinned.

Hair pins and particularly bobby pins are also used to hold a wig or hair piece to the natural hair of a wearer. Current bobby pins rely upon a single resilient pincer to concurrently hold the natural hair and the hair piece. This has not been satisfactory because the hair within the pin tends to slide out through the open end of the pin when the wig or hair piece is moved with respect to the natural hair of the wearer.

SUMMARY OF THE INVENTION

Basically, this invention comprises a hair pin made from a resilient band folded back on opposite sides to form a loop and an adjacent tine at each end providing a pair of pincers disposed in opposite directions. When hair is placed in the loops, an anchoring force at each end is provided to minimize movement of the pin with respect to the hair.

When the pin of this invention is used with a hair piece, one pincer holds a strand of the hair piece, while the opposite pincer grips a strand of natural hair on the wearer's head. The combined opposite holding forces by the pincers respectively on the hair piece, and the hair of the wearer, minimize accidental withdrawal of the hair piece from the wearer's head.

Another advantage of this invention is that when hair is inserted in the pin, the rounded portion of the loop is easily grasped and provides a more accessible entrance for the hair strand, thus facilitating a greater amount of hair being received by the pin, and less unpinned wisps of hair.

The invention enables the user to use less pins than are currently necessary because each pin substantially performs the function of two current pins and in a superior manner. Furthermore, when the pins of this invention are used they are less in view than current pins because the inner pincers of the pin are covered by the hair held in the exposed pincers.

DESCRIPTION OF THE PREFERRED EMBODIMENT

Figure 1:
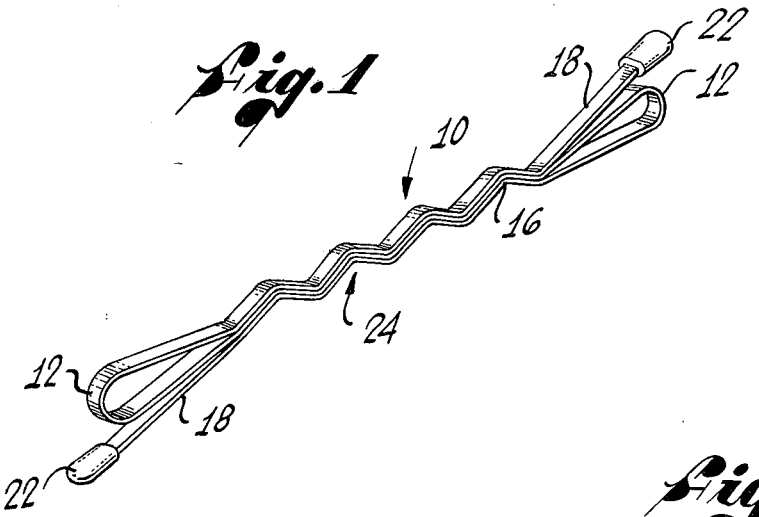
FIG. 1 is a perspective view of the invention.
Figure 2:
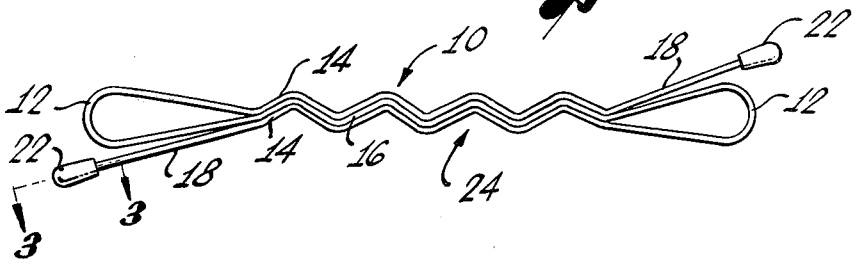
FIG. 2 is an elevation view of the invention.

The invention as seen in FIGS. 1 and 2 comprises a pin 10 made from a band of resilient material, such as a continuous band of metal. The band is folded back on opposite sides upon itself, thereby forming three portions. The folds provide a loop 12 at each end and two outer members 14 which overlie an inner member 16 formed from the intermediate portion of the band.

Thus, the outer members 14 in combination with the inner member 16 form a pair of oppositely disposed pincers having a common inner member.

Figure 3:
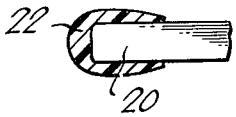
FIG. 3 is a fragmented sectional view taken along line 3—3 of FIG. 2.

The outer members 14 extend slightly beyond the outer extremeties of the loops 12, and terminate in outwardly flared tines 18. As seen more clearly in FIG. 3, the terminal end regions 20 of the tines 18 are preferably coated with a plastic material 22 to form a bulbous end region to minimize punctures and for ease of operation. The spaces between the adjacent loops 12 and tines 18 at each end of the pin provide an easy entrance to a strand of hair which is inserted in the pin, by the loops forming a partially rounded entryway.

The intermediate longitudinal portion of the outer members 14 and the common inner member 16 of the pin 10 are crimped into compact relationship for substantially their entire length between the loops 12 to enhance the holding characteristics of the pin on strands of hair.

Figure 4:
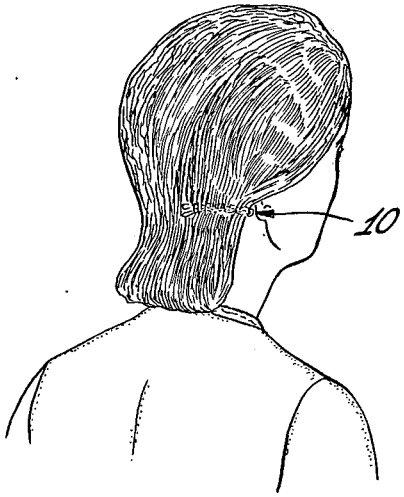
FIG. 4 shows the pin in a wearer's hair.
Figure 5:
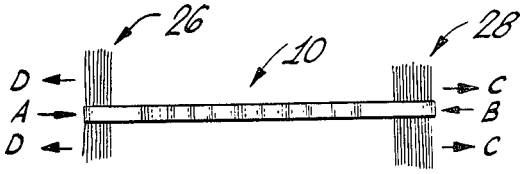
FIG. 5 shows a partially fragmented view of the pin in a wearer's hair, with arrows representing forces on the pin.

When the pin 10 is placed in the hair of a wearer as illustrated in FIGS. 4 and 5, the strands within the loops 12 at each end anchor the pin, and Minimize movement. For example, when the pin 10 is moved in the direction of arrow A, as shown in FIG. 5, the hair strand 26 provides a holding force as shown by the arrows D. When the hair pin 10 is moved in the direction of arrow B, the hair strand 28 provides a holding force as shown by the arrows C. Thus, to remove the pin 10 without substantial wrenching, the strands of hair 26 and 28 must be slid out of the pincers of the pin, by sliding each strand in opposite directions relative to the pin.

The foregoing description of this invention is illustrative of the presently preferred embodiment of the invention, and is not meant to limit the invention to the specific apparatus disclosed.

I claim:

1. A hair pin comprising:

a continuous band of resilient material folded back upon itself on opposite sides to form a loop at each end of said pin, each loop having a crimped outer leg which extends the length of said pin to form a flared tine which terminates adjacent the other loop, said loops further having a common crimped inner leg extending substantially the length of said pin intermediate said loops, which is in crimped compact mating relationship with the outer legs for substantially its entire length between said loops to provide a pair of oppositely disposed crimped pincers.

* * * * *